US009683502B2

(12) United States Patent
Uhrich et al.

(10) Patent No.: US 9,683,502 B2
(45) Date of Patent: Jun. 20, 2017

(54) METHOD AND SYSTEM FOR IDENTIFICATION AND MITIGATION OF AIR-FUEL RATIO IMBALANCE

(71) Applicant: Ford Global Technologies, LLC, Dearborn, MI (US)

(72) Inventors: Michael James Uhrich, West Bloomfield, MI (US); Mario Anthony Santillo, Canton, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 129 days.

(21) Appl. No.: 14/845,747

(22) Filed: Sep. 4, 2015

(65) Prior Publication Data

US 2017/0067402 A1 Mar. 9, 2017

(51) Int. Cl.
*F02D 41/14* (2006.01)
*F02D 41/00* (2006.01)

(52) U.S. Cl.
CPC ..... *F02D 41/0085* (2013.01); *F02D 41/1441* (2013.01); *F02D 41/1454* (2013.01)

(58) Field of Classification Search
CPC ..... F02D 41/00; F02D 41/14; F02D 41/0085; F02D 41/1441; F02D 41/1454
See application file for complete search history.

(56) References Cited

U.S. PATENT DOCUMENTS

| | | | | |
|---|---|---|---|---|
| 5,255,662 | A * | 10/1993 | Nakajima | F02D 41/1441 123/672 |
| 7,802,563 | B2 | 9/2010 | Behr et al. | |
| 7,823,563 | B2 | 11/2010 | Jankovic et al. | |
| 7,896,128 | B2 | 3/2011 | De Leo et al. | |
| 7,963,109 | B2 | 6/2011 | Nagaoka et al. | |
| 8,326,516 | B2 * | 12/2012 | Asano | F02D 13/0219 123/90.15 |
| 8,381,707 | B2 * | 2/2013 | Mizoguchi | F01N 11/007 123/696 |
| 8,695,568 | B2 | 4/2014 | Yoshikawa | |

OTHER PUBLICATIONS

Uhrich, Michael James et al., "Dual Hego Method for Identification and Mitigation of Air-Fuel Imbalance Faults," U.S. Appl. No. 14/334,375, filed Jul. 17, 2014, 46 pages.

* cited by examiner

*Primary Examiner* — Hieu T Vo
(74) *Attorney, Agent, or Firm* — Julia Voutyras; McCoy Russell LLP

(57) ABSTRACT

Methods and systems are provided for identifying imbalanced cylinder and mitigating the imbalanced cylinder. In one example, a method may include identifying an imbalanced cylinder based on readings from two exhaust gas oxygen sensors positioned upstream and downstream of a catalyst in an exhaust passage, and mitigating the imbalance based on the magnitude of a fault determined from the readings.

20 Claims, 4 Drawing Sheets

| | $\Phi_1$ | $\Phi_2$ | Cylinder Imbalance | Magnitude of fault |
|---|---|---|---|---|
| 1 | >1 | =1 | Cylinder 1 rich | $\Phi_1/\Phi_2 - 1$ |
| 2 | <1 | =1 | Cylinder 1 lean | $1 - \Phi_1/\Phi_2$ |
| 3 | >1 | >1 | Cylinder 2 rich | $\Phi_1 - 1$ OR $\Phi_2 - 1$ |
| 4 | <1 | <1 | Cylinder 2 lean | $1 - \Phi_1$ OR $1 - \Phi_2$ |
| 5 | =1 | >1 | Cylinder 3 rich | $\Phi_2/\Phi_1 - 1$ |
| 6 | =1 | <1 | Cylinder 3 lean | $1 - \Phi_2/\Phi_1$ |

FIG. 4

METHOD AND SYSTEM FOR IDENTIFICATION AND MITIGATION OF AIR-FUEL RATIO IMBALANCE

FIELD

The present description relates generally to methods and systems for identifying imbalanced engine cylinder and mitigating the imbalance.

BACKGROUND/SUMMARY

Modern vehicles use three-way catalysts (TWC) for exhaust after-treatment of gasoline engines. With tightening government regulations on automobile emissions, air-fuel ratio of each engine cylinder in a multi-cylinder engine is closely monitored. Ideally, each engine cylinder should be designated with an exhaust gas composition sensor for accurately measuring the air-fuel ratio of the cylinder. However, due to affordability constraints, in practice, exhaust gas oxygen sensors positioned upstream and downstream of the TWC may be used to control the air-fuel ratio near stoichiometry.

Other attempts to address cylinder imbalance include detecting and mitigating air-fuel ratio imbalance based on a pre-catalyst and a post-catalyst sensor. One example approach is shown by Yoshikawa et al. in U.S. Pat. No. 8,695,568 B2. Therein, an air-fuel ratio control unit performs main air-fuel ratio control based on the output of the pre-catalyst sensor and auxiliary air-fuel ratio control based on the output of the post-catalyst sensor. The inter-cylinder imbalance is further detected based on the variation of engine speed.

However, the inventors herein have recognized potential issues with such systems. As one example, the pre-catalyst and post-catalyst sensors may have different sensitivity to the air-fuel ratio of each engine cylinder due to zoned exhaust flow. Especially in naturally aspirated engines, the physical geometry and arrangement of engine cylinders create a non-uniform, zoned exhaust flow condition in the exhaust system. Due to monolithic catalyst designs that may be used in some examples, zoned exhaust flow is preserved through the catalyst. Various faults, such as an air-fuel ratio imbalance between cylinders, may exacerbate this non-uniform, zoned exhaust flow condition so that neither the pre-catalyst nor the post-catalyst sensor may equally detect the exhaust gas concentration from all of the cylinders. As such, the air-fuel ratio control performed in U.S. Pat. No. 8,695,568 B2 may not successfully mitigate the imbalance.

In one example, the issues described above may be addressed by a method for identifying and mitigating cylinder imbalance, comprising: identifying an imbalanced cylinder based on each of a first sensor positioned upstream of a catalyst and a second sensor downstream of the catalyst, wherein the first and the second sensors are positioned on opposite sides relative to a central axis of an exhaust passage; and adjusting an air-fuel ratio of the imbalanced cylinder based on a magnitude of the fault via fuel injectors. In this way, the imbalanced cylinder may be identified utilizing the zoned exhaust flow. Further, air-fuel ratio in the imbalanced cylinder may be corrected without extra measurement.

As one example, cylinder-to-cylinder imbalance may be detected based on the outputs of a pre-catalyst sensor and a post-catalyst sensor. The pre-catalyst sensor is positioned on opposite sides relative to a central axis of the exhaust passage. In response to identifying the imbalanced cylinder, the magnitude of fault in air-fuel ratio is calculated for the imbalanced cylinder. The amount of fuel injection to the imbalanced cylinder is then corrected based on magnitude of the fault. As such, air-fuel ratio information of both individual cylinder and multiple cylinders in a cylinder bank may be measured and controlled. In this way, instead of mitigating the zoned exhaust flow for improved air-fuel ratio control, zoned exhaust flow is accepted and utilized to determine and subsequently correct cylinder-to-cylinder imbalance.

The technical effect of identifying an imbalanced cylinder with two sensors positioned on opposite sides relative to the center line of the exhaust passage is that the air-fuel ratio of each cylinder may be accurately detected by different sensors. The technical effect of positioning a pre-catalyst sensor upstream of the catalyst and a post-catalyst sensor downstream of the catalyst is that the total number of exhaust gas oxygen sensors used in the engine system may be minimized. The technical effect of adjusting the air-fuel ratio of the imbalanced cylinder based on the outputs of the pre-catalyst and the post-catalyst sensor is that the cylinder-to-cylinder imbalance may be mitigated without acquiring extra information about the engine system. As such, the current method simplifies the detection and mitigation of cylinder-to-cylinder imbalance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 4 shows an example look-up table for identifying an imbalanced cylinder and determining a magnitude of fault of the imbalanced cylinder based on output of two exhaust oxygen sensors.

DETAILED DESCRIPTION

Figure 2:
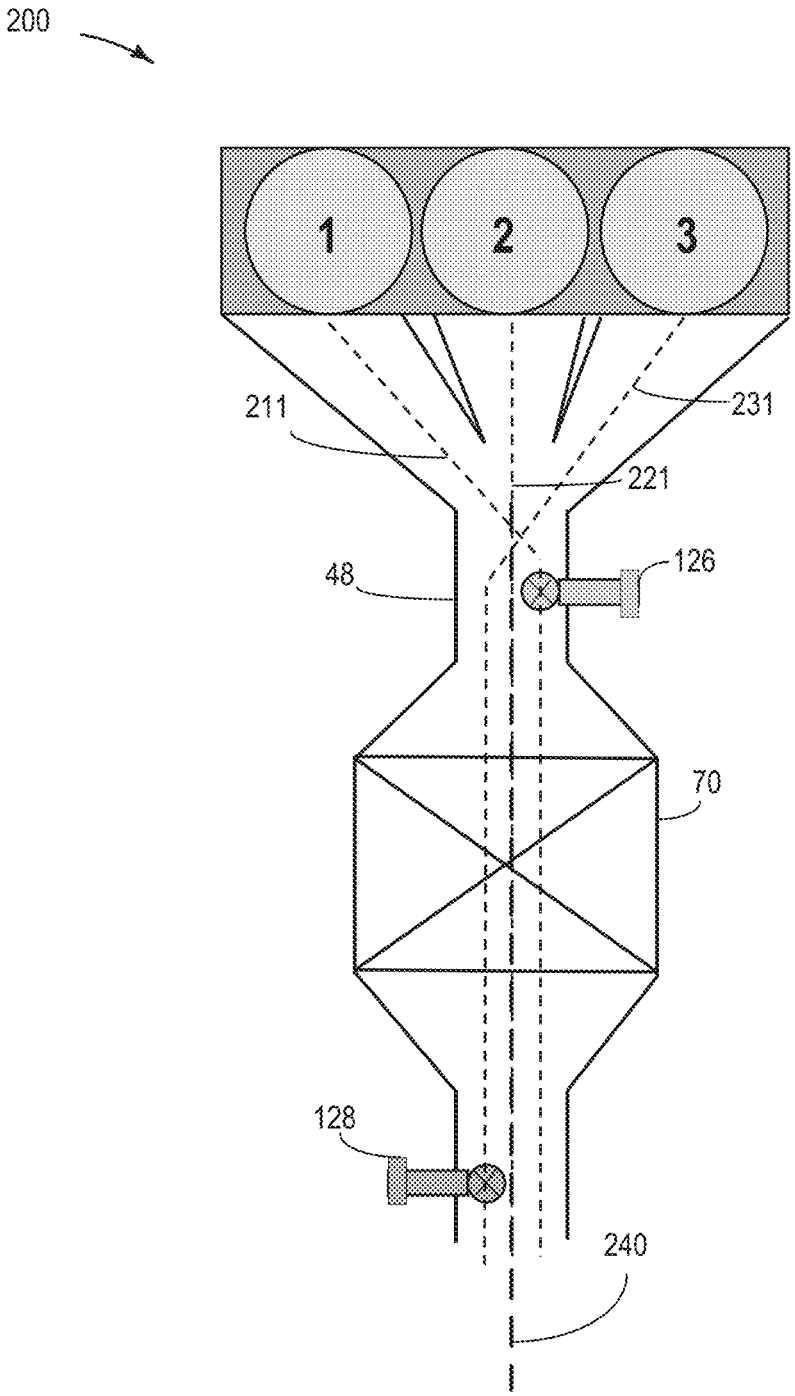
FIG. 2 demonstrates zoned exhaust flow in an exhaust after-treatment system.
Figure 3:
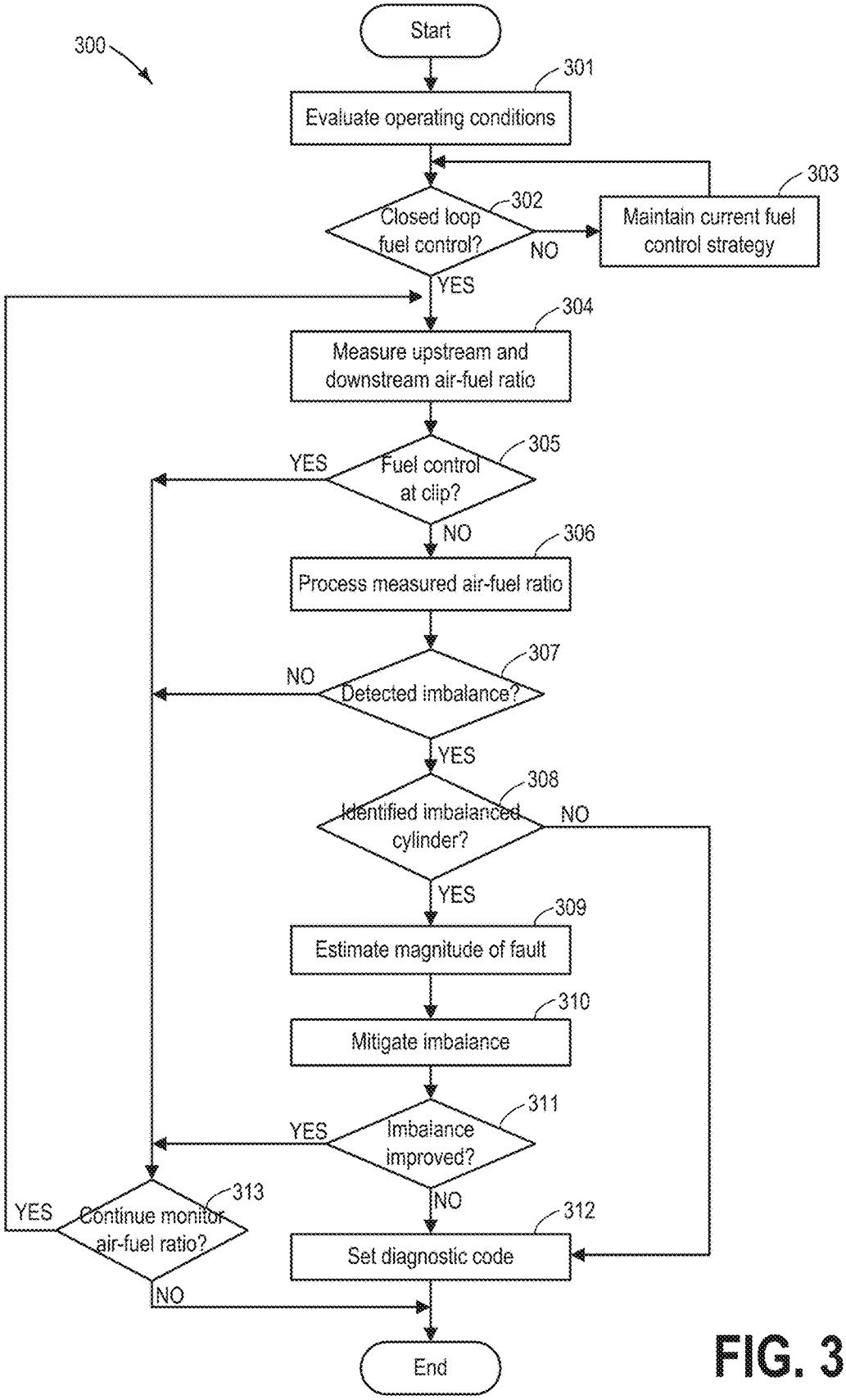
FIG. 3 shows a flow chart illustrating an example method for detecting and mitigating cylinder-to-cylinder imbalance.

The following description relates to systems and methods for detecting and mitigating cylinder-to-cylinder imbalance. The systems and methods may be implemented in a vehicle, such as the vehicle system depicted in FIG. 1. As shown in FIG. 2, the vehicle may include a multi-cylinder engine system and an exhaust after-treatment system. If one of the multiple cylinders has a fault that creates an air-fuel imbalance, the exhaust composition may be non-uniform across the cross-section of an exhaust passage and a single exhaust gas oxygen sensor may not detect the imbalance. In order to detect and mitigate air-fuel ratio imbalance when the imbalance fault is small, a pre-catalyst sensor and post-catalyst sensor coupled to the exhaust passage are utilized in the engine system. Due to zoned exhaust flow shown in FIG. 2, the pre-catalyst and post-catalyst sensors have different sensitivity to the air-fuel ratio of each engine cylinder. Utilizing the different sensitivity, FIG. 3 shows an example method for identifying and mitigating cylinder-to-cylinder air-fuel ratio imbalance. FIG. 4 shows an example look-up table for determining the imbalanced cylinder based on readings of the pre-catalyst and post-catalyst sensors. Further, the magnitude of fault of the imbalanced cylinder may also be determined.

Figure 1:
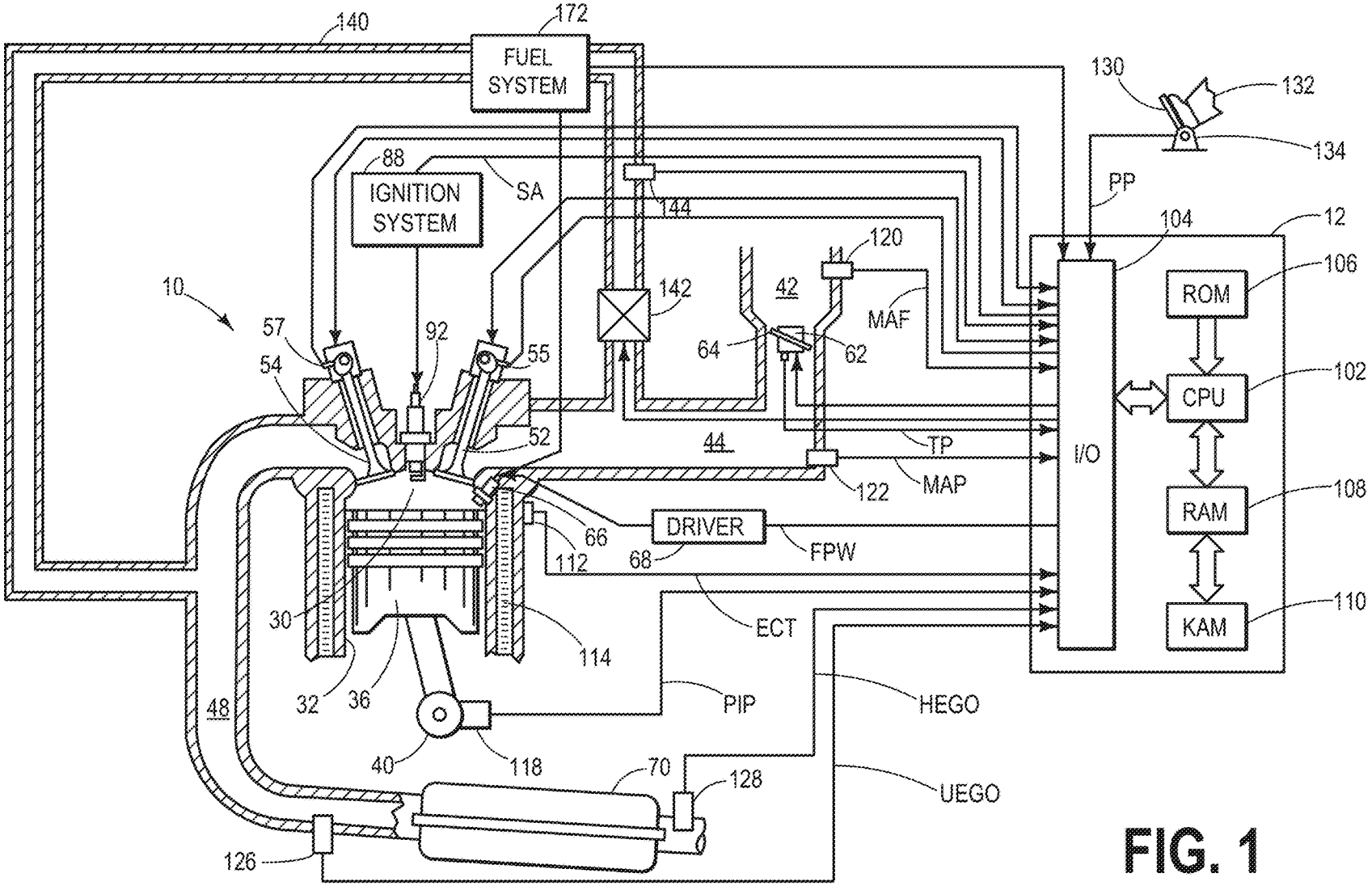
FIG. 1 shows a schematic depiction of an example vehicle system.

FIG. 1 illustrates a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves. In this example, intake valve 52 and exhaust valve 54 may be controlled by cam actuation via one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

In some embodiments, each cylinder of engine 10 may be configured with one or more fuel injectors for providing fuel thereto. As a non-limiting example, cylinder 30 is shown including one fuel injector 66, which is supplied fuel from fuel system 172. Fuel injector 66 is shown coupled directly to cylinder 30 for injecting fuel directly therein in proportion to the pulse width of signal FPW received from controller 12 via electronic driver 68. In this manner, fuel injector 66 provides what is known as direct injection (hereafter also referred to as "DI") of fuel into combustion cylinder 30.

It will be appreciated that in an alternate embodiment, injector 66 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Continuing with FIG. 1, intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

A pre-catalyst exhaust gas oxygen sensor 126 is shown coupled to exhaust passage 48 upstream of emission control device 70. Pre-catalyst sensor 126 may be any suitable sensor for providing an indication of exhaust gas air-fuel ratio such as a linear wideband oxygen sensor or UEGO (universal or wide-range exhaust gas oxygen), a two-state narrowband oxygen sensor or EGO, a HEGO (heated EGO), a NOx, HC, or CO sensor. In one embodiment, pre-catalyst sensor 126 is a UEGO configured to provide output, such as a voltage signal, that is proportional to the amount of oxygen present in the exhaust. Controller 12 uses the output to determine the exhaust gas air-fuel ratio.

Emission control device 70 is shown arranged along exhaust passage 48 downstream of pre-catalyst sensor 126. Device 70 may be a three-way catalyst (TWC), configured to reduce NOx and oxidize CO and unburnt hydrocarbons. In some embodiments, device 70 may be a NOx trap, various other emission control devices, or combinations thereof.

A second, post-catalyst exhaust gas oxygen sensor 128 is shown coupled to exhaust passage 48 downstream of emissions control device 70. Post-catalyst sensor 128 may be positioned opposite to the pre-catalyst sensor 126 relative to the central axis of exhaust passage 48 (shown in detail in FIG. 2). Downstream sensor 128 may be any suitable sensor for providing an indication of exhaust gas air-fuel ratio such as a UEGO, EGO, HEGO, etc. In one embodiment, post-catalyst sensor 128 may be a HEGO configured to indicate the relative enrichment or enleanment of the exhaust gas after passing through the catalyst. As such, the HEGO may provide output in the form of a switch point, or the voltage signal at the point at which the exhaust gas switches from lean to rich.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor 144 may be arranged within the EGR passage and may provide an indication of one or more of pressure, temperature, and concentration of the exhaust gas. Under some conditions, the EGR system may be used to regulate the temperature of the air and fuel mixture within the combustion chamber.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure (MAP) signal from sensor 122. Engine speed, RPM, may be generated by controller 12 from signal PIP. Controller 12 employs the various actuators of FIG. 1 to adjust engine operation based on the received signals and instructions stored on a memory of the controller. For example, combustion air-fuel ratio may be adjusted by adjusting an amount of fuel injected into cylinder 30 via fuel injector 92.

Storage medium read-only memory 106 can be programmed with computer readable data representing non-transitory instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

FIG. 2 demonstrates non-uniform zoned exhaust flow in exhaust passage 48 of an example three-cylinder engine system 200. Engine system 200 includes three cylinders 1, 2, and 3. Catalyst 70 is coupled to exhaust passage 48. The central axis of catalyst 70 overlaps with the central axis of exhaust passage 240. Pre-catalyst sensor 126 is coupled to exhaust passage 48 upstream of catalyst 70, and post-catalyst sensor 128 is coupled to exhaust passage downstream of catalyst 70. The pre-catalyst and post-catalyst sensors are positioned on opposite side of the exhaust passage relative to the central axis of exhaust passage 240. Central axis 240 is a longitudinal axis along a direction of exhaust flow through channels of the catalyst brick. Comparing to post-catalyst sensor 128, more exhaust gas from cylinder 1 flows through pre-catalyst sensor 126, as shown in dashed line 211. Comparing to pre-catalyst sensor 126, more exhaust gas from cylinder 3 flows through post-catalyst sensor 128, as shown in dashed line 231. Most of the exhaust gas from cylinder 2 flows through the central axis of the exhaust passage 240. As such, pre-catalyst sensor 126 is more sensitive to the air-fuel ratio of cylinder 1; and post-catalyst sensor 128 is more sensitive to the air-fuel ratio of cylinder 3. Pre-catalyst sensor 126 and post-catalyst sensor 128 have same sensitivity to the air-fuel ratio of cylinder 2.

FIG. 3 shows an example method 300 for determining an imbalanced cylinder and mitigating the imbalance based on readings from a pre-catalyst sensor (such as sensor 126 in FIG. 2) and a post-catalyst sensor (such as sensor 128 in FIG. 2).

Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

Method 300 begins at 301, wherein the operating conditions are evaluated. Operating conditions may include, but are not limited to, engine operating status, combustion air-fuel ratio, engine coolant temperature, catalyst temperature, etc. Operating conditions may be measured by one or more sensors coupled to the controller, or may be estimated or inferred based on available data.

At 302, method 300 determines air-fuel ratio control strategy based on the evaluated operating conditions. The fuel control strategy may be implemented by a fuel control module in the controller. The control strategy may include open loop and closed loop fuel control. In the open loop fuel control, an amount of fuel is injected according to a predetermined relationship between an air-fuel ratio and corresponding fuel injector operation. In the closed loop fuel control, the fuel injection amount may be determined based on a feedback of air-fuel ratio measured from the pre-catalyst exhaust gas oxygen sensor or the post-catalyst exhaust gas oxygen sensor. In an example, the closed loop fuel control may be implemented with a PID controller. The amount of fuel injected into engine cylinder may be adjusted by adjusting a multiplier in the fuel control module.

If open loop fuel control is selected, method 300 continues to 303, wherein the engine is operated with current fuel control strategy. If closed loop fuel control is selected, method 300 continues to 304.

At 304, method 300 measures upstream and downstream air-fuel ratio with the pre-catalyst sensor and the post-catalyst sensor. Based on the measured air-fuel ratio, exhaust gas composition and the air-fuel composition before the combustion may be determined.

A stoichiometric air-fuel ratio for gasoline is typically near 14.7. The air-fuel ratio may be presented as relative air-fuel ratio lambda, $\lambda$. The stoichiometric relative air-fuel ratio is near 1. The reciprocal of $\lambda$ is the equivalence ratio, $\Phi$. The equivalence ratio is a relative fuel-air ratio and is typically near 1 for stoichiometric combustion.

In an embodiment, the pre-catalyst sensor is an UEGO sensor, and the post-catalyst sensor is a HEGO sensor. Readings from the HEGO sensor may be converted based on a transfer function so that they are comparable to the readings from the UEGO sensor.

At 305, method 300 determines whether the fuel injection amount may be adjusted without restrictions. For example, method 300 may check if the fuel control is at clip when PID controller is used. In order to avoid integrator windup, the integral value in the PID controller may be clipped. If fuel control is at clip, method 300 determines whether to continue monitoring air-fuel ratio at 313. If fuel control is not at clip, method 300 continues to 306.

At 313, method 300 determines whether it is necessary to continue monitoring the air-fuel ratio in the closed up fuel control. For example, in response to a change in operating conditions, method 300 may determine to exit. If method 300 determines to continue monitoring the air-fuel ratio, air-fuel ratio upstream and downstream of the catalyst is measured at 304. Otherwise, method 300 ends.

At 306, measured air-fuel ratios from both pre-catalyst and post-catalyst sensors are processed. In an example, the measurement may be averaged and filtered to remove high frequency noise and increase signal to noise ratio.

At 307, method 300 determines if cylinder air-fuel ratio imbalance exists. If the relative fuel-air ratios of the pre-catalyst and post-catalyst sensors both equal to 1, method 300 may determine that the cylinders are balanced and no further adjustment is necessary. Method 300 then continues to 313 and may continue monitoring air-fuel ratios through closed loop fuel control if necessary. If one of the relative fuel-air ratios from the pre-catalyst and post-catalyst sensors does not equal to 1, method 300 continues to 308 to identify the imbalanced cylinder.

At 308, method 300 determines whether the imbalanced cylinder may be determined based on the processed measurement from 306. For example, if the two exhaust gas oxygen sensors have opposite readings, such as when the relative fuel-air ratio of one sensor is greater than 1 and the relative fuel-air ratio of the other sensor is less than 1, then the imbalanced cylinder cannot be determined. Method 300 then moves to 312, wherein corresponding diagnostic code may be set.

Otherwise, if readings from the two exhaust gas oxygen sensors both are rich or lean, or if the relative fuel-air ratio of one exhaust gas oxygen sensor equals to 1, the imbalanced cylinder and the type of imbalance fault (imbalance rich or imbalance lean) may be determined based on a lookup table. The lookup table may be constructed based on the measurement of the pre-catalyst and post-catalyst sensors.

In an embodiment, the imbalance fault may be determined by one of the exhaust gas oxygen sensors with a higher sensitivity to the air-fuel ratio of the imbalanced cylinder. As an example, for a three-cylinder bank of cylinders, the imbalanced cylinder may be determined based on the lookup table show in FIG. 4. In FIG. 4, the fuel-air ratio of the pre-catalyst sensor $\phi_1$ and the relative fuel-air ratio of post-catalyst sensor $\phi_2$ may be acquired from an engine system shown in FIGS. 1-2. In a first example, if the relative fuel-air ratio of the pre-catalyst sensor is greater than 1 and the relative fuel-air ratio of the post-catalyst sensor is equal to 1, method 300 may determine that cylinder 1 is imbalance rich. In a second example, if the relative fuel-air ratio of the pre-catalyst sensor is less than 1 and the relative fuel-air ratio of the post-catalyst sensor is equal to 1, method 300 may determine that cylinder 1 is imbalance lean. In a third example, if the relative fuel-air ratio of the pre-catalyst sensor is greater than 1 and the relative fuel-air ratio of the post-catalyst sensor is greater than 1, method 300 may determine that cylinder 2 is imbalance rich. In a fourth example, if the relative fuel-air ratio of the pre-catalyst sensor is less than 1 and the relative fuel-air ratio of the post-catalyst sensor is less than 1, method 300 may determine that cylinder 2 is imbalance lean. In a fifth example, if the relative fuel-air ratio of the pre-catalyst sensor is equal to 1 and the relative fuel-air ratio of the post-catalyst sensor is greater than 1, method 300 may determine that cylinder 3 is imbalance rich. In a sixth example, if the relative fuel-air ratio of the pre-catalyst sensor is equal to 1 and the relative fuel-air ratio of the post-catalyst sensor is less than 1, method 300 may determine that cylinder 3 is imbalance lean. After identifying the imbalanced cylinder and corresponding cylinder fault, method 300 moves to 309.

At 309, magnitude of fault of the imbalanced cylinder is determined. In an embodiment, the magnitude of fault may be determined based on the sensor with higher sensitivity to the air-fuel ratio of the imbalanced cylinder. For example, if it is determined that cylinder 1 is imbalance rich at step 308 (such as the first example at 308), the reading of the pre-catalyst sensor, which is more sensitive to the air-fuel ratio of cylinder 1, may be used to calculate the magnitude of fault. Specifically, the rich fault of cylinder 1 may be calculated with $\phi_1-1$. In another example, if it is determined that cylinder 2 is imbalance lean at step 308 (such as the fourth example at 308), since the pre-catalyst sensor and the post-catalyst sensor have the same sensitivity to the air-fuel ratio of cylinder 2, relative fuel-air ratio from either one of sensors may be used to calculated the magnitude of fault. Specifically, the lean fault of cylinder 2 may be calculated with $1-\phi_1$, or $1-\phi_2$.

In another embodiment, the magnitude of fault may be determined by the ratio between the pre-catalyst sensor output $\phi_1$ and the post-catalyst sensor output $\phi_2$. As shown in FIG. 4, in a first example, if cylinder 1 is imbalance rich, the magnitude of fault may be calculated with $\phi_1/\mu_2-1$. In a second example, if cylinder 1 has been determined imbalance lean, the magnitude of fault may be calculated with $1-\phi_1/\phi_2$. In a third example, if cylinder 2 has been determined imbalanced rich, the magnitude of fault may be calculated with $\phi_1-1$ or $\phi_2-1$. In a fourth example, if cylinder 2 has been determined imbalanced lean, the magnitude of fault may be calculated with $1-\phi_1$ or $1-\phi_2$. In a fifth example, if cylinder 3 has been determined imbalance rich, the magnitude of fault may be calculated with $\phi_2/\phi_1-1$. In a sixth example, if cylinder 3 has been determined imbalance lean, the magnitude of fault may be calculated with $1-\phi_2/\phi_1$.

At 310, cylinder-to-cylinder imbalance is mitigated via adjusting the amount of fuel injected into the imbalanced cylinder. The fuel adjustment amount is based on the magnitude of fault determined at step 309. The fuel adjustment may be implemented by adjusting a multiplier in the fuel control module of the controller. For an imbalance rich cylinder, the multiplier may be set with the difference between 1 and the magnitude of fault. For example, if the imbalanced cylinder is imbalance rich with a magnitude of fault equal to 30%, the multiplier may be set to 1−30%=70%. For an imbalance lean cylinder, the multiplier may be set with the sum of the magnitude of the fault and 1. For example, if the imbalanced cylinder is imbalanced lean with a magnitude of fault equal to 30%, the multiplier may be set to 1+30%=130%.

At 311, method 300 determines whether cylinder imbalance is improved. The improvement may be determined by comparing current exhaust gas oxygen sensor output with the output acquired before mitigating the imbalance. For example, if current relative relative fuel-air ratio from both exhaust gas oxygen sensors are approaching 1 more compared to the readings before mitigating the imbalance, method 300 determines that there is an improvement and moves to 313. At 313, method 300 determines whether to continue monitoring the air-fuel ratio. If there is no improvement in cylinder imbalance, method 300 sets a diagnostic code at 312 and then exit.

In this way, based on different sensitivities of the two exhaust gas oxygen sensors to the air-fuel ratio of each cylinder, cylinder-to-cylinder imbalance may be identified. The imbalanced cylinder and the magnitude of fault may also be determined based on the sensor output without extra measurement. Air-fuel ratio imbalance in the imbalanced cylinder may further be mitigated by adjusting the fuel injection amount based on the magnitude of fault calculated from the sensor outputs. As such, utilizing the zoned exhaust flow, imbalanced cylinder may be quickly identified and mitigated in the closed loop fuel control with simple calculations. The current method may further be combined with other feedback control methods to achieve fast air-fuel ratio adjustment during imbalance.

As one embodiment, a method for a multi-cylinder engine includes identifying an imbalanced cylinder based on each of a first sensor positioned upstream of a catalyst and a second sensor downstream of the catalyst, wherein the first and the second sensors are positioned on opposite sides relative to a central axis of the exhaust passage; and adjusting an air-fuel ratio of the imbalanced cylinder via fuel injectors. In a first example of the method, the first sensor is more sensitive to the air-fuel ratio of a first cylinder than the rest of the cylinders, wherein the central axis is a longitudinal axis along a direction of exhaust flow through channels of the catalyst brick. A second example of the method optionally includes the first example and further includes wherein the second sensor is more sensitive to the air-fuel ratio of a third cylinder than the rest of the cylinders. A third example of the method optionally includes one or more of the first and second examples, and further includes wherein the first and the second sensors have the same sensitivity to the air-fuel ratio of a second cylinder. A fourth example of the method optionally includes one or more of the first through third examples, and further includes, wherein air-fuel ratio of the second cylinder is imbalanced rich if readings of both the first and the second sensors are rich. A fifth example of the method optionally includes one or more of the first through fourth examples, and further includes, wherein air-fuel ratio of the second cylinder is imbalanced lean if readings of both the first and the second sensors are lean. A sixth example of the method optionally includes one or more of the first through fifth examples, and further includes, wherein the air-fuel ratio of the imbalanced cylinder is adjusted based on a magnitude of a fault of the imbalanced cylinder determined based on one of the first sensor and the second sensor with higher sensitivity to the air-fuel ratio of the imbalanced cylinder. A seventh example of the method optionally includes one or more of the first through sixth examples, and further includes, wherein the first sensor is an UEGO sensor and the second sensor is a HEGO sensor.

As one embodiment, a method for a multi-cylinder engine includes detecting a cylinder-to-cylinder imbalance based on each of a first sensor upstream of a catalyst and a second sensor downstream of the catalyst, wherein the first sensor and the second sensor have different sensitivities to an air-fuel ratio of each cylinder; determining a magnitude of a fault in an imbalanced cylinder based on each of the first and the second sensor; and mitigating the cylinder-to-cylinder imbalance based on the magnitude of the fault by adjusting fuel injected into the imbalanced cylinder. In a first example of the method, the first and second sensors are positioned on opposite sides relative to a central axis of an exhaust passage. A second example of the method optionally includes the first example and further includes wherein the first sensor is more sensitive to the air-fuel ratio of a first cylinder than the rest of the cylinders, the second sensor is more sensitive to the air-fuel ratio of a third cylinder than the rest of the cylinders, and the first and the second sensors have a same sensitivity to the air-fuel ratio of a second cylinder. A third example of the method optionally includes one or more of the first and second examples, and further includes the magnitude of the fault of the first cylinder is based on a ratio between relative fuel-air ratios from the first and the second sensors, the magnitude of the fault of the third cylinder is based on a ratio between relative fuel-air ratios from the second and the first sensors. A fourth example of the method optionally includes one or more of the first through third examples, and further includes, wherein the magnitude of the fault of the second cylinder is based on comparing a relative fuel-air ratio from the first sensor with 1. A fifth example of the method optionally includes one or more of the first through fourth examples, and further includes, wherein the magnitude of the fault of the second cylinder is based on comparing a relative fuel-air ratio from the second sensor with 1. A sixth example of the method optionally includes one or more of the first through fifth examples, and further includes, wherein the fuel injected into the imbalanced cylinder is adjusted via updating a multiplier of the fuel injector associated with the imbalanced cylinder, and the updated amount of the multiplier is based on the magnitude of the fault of the imbalanced cylinder.

As one embodiment, an engine system includes a plurality of cylinders; at least one fuel injector for injecting fuel into each of the cylinders; an exhaust passage; a catalyst coupled to the exhaust passage; a first exhaust gas oxygen sensor coupled to the exhaust passage upstream of the catalyst; a second exhaust gas oxygen sensor coupled to the exhaust passage downstream of the catalyst, wherein the first and second gas oxygen sensors are positioned opposite to each other relative to a central axis of the exhaust passage; and a controller configured with computer readable instructions stored on non-transitory memory for: identifying an imbalanced cylinder via a look-up table based on the readings of the pre-catalyst and post-catalyst exhaust gas oxygen sensors; and in response to identifying the imbalanced cylinder, mitigating the imbalanced cylinder based on a magnitude of a fault of the imbalanced cylinder. In a first example of the method, wherein more exhaust gas from a first cylinder flows through the first exhaust gas oxygen sensor than exhaust gas from a third cylinder, and more exhaust gas from a third cylinder flows through the second exhaust gas oxygen sensor than the exhaust gas from a first cylinder. A second example of the method optionally includes the first example and further includes, wherein the magnitude of the fault of the imbalanced cylinder is determined based on readings of the first and second exhaust gas oxygen sensors. A third example of the method optionally includes one or more of the first and second examples, and further includes, wherein the imbalanced cylinder is mitigated by adjusting an amount of fuel injected to the imbalanced cylinder via a fuel injector. A fourth example of the method optionally includes one or more of the first through third examples, and further includes, wherein the first exhaust gas oxygen sensor is an UEGO sensor and the second exhaust gas oxygen sensor is a HEGO sensor, and output of the HEGO sensor is converted via a transfer function.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system, comprising:

a plurality of cylinders;

at least one fuel injector for injecting fuel into each of the cylinders;

an exhaust passage;

a catalyst coupled to the exhaust passage;

a first exhaust gas oxygen sensor coupled to the exhaust passage upstream of the catalyst;

a second exhaust gas oxygen sensor coupled to the exhaust passage downstream of the catalyst, wherein the first and second exhaust gas oxygen sensors are positioned opposite to each other relative to a central axis of the exhaust passage; and a controller configured with computer readable instructions stored on non-transitory memory for:

identifying an imbalanced cylinder via a look-up table based on readings of the pre-catalyst and post-catalyst exhaust gas oxygen sensors; and in response to identifying the imbalanced cylinder, mitigating the imbalanced cylinder based on a magnitude of a fault of the imbalanced cylinder.

2. The engine system of claim 1, wherein more exhaust gas from a first cylinder flows through the first exhaust gas oxygen sensor than exhaust gas from a third cylinder, and more exhaust gas from a third cylinder flows through the second exhaust gas oxygen sensor than exhaust gas from a first cylinder.

3. The engine system of claim 1, wherein the magnitude of the fault of the imbalanced cylinder is determined based on readings of the first and second exhaust gas oxygen sensors.

4. The engine system of claim 1, wherein the imbalanced cylinder is mitigated by adjusting an amount of fuel injected to the imbalanced cylinder via a fuel injector.

5. The engine system of claim 1, wherein the first exhaust gas oxygen sensor is an UEGO sensor and the second exhaust gas oxygen sensor is a HEGO sensor, and output of the HEGO sensor is converted via a transfer function.

6. A method for a multi-cylinder engine, comprising:

identifying an imbalanced cylinder based on each of a first sensor positioned upstream of a catalyst and a second sensor downstream of the catalyst, wherein the first and the second sensors are positioned on opposite sides relative to a central axis of an exhaust passage; and adjusting an air-fuel ratio of the imbalanced cylinder via a fuel injector.

7. The method of claim 6, wherein the first sensor is more sensitive to the air-fuel ratio of a first cylinder than the rest of the cylinders, wherein the central axis is a longitudinal axis along a direction of exhaust flow through channels of the catalyst brick.

8. The method of claim 6, wherein the second sensor is more sensitive to the air-fuel ratio of a third cylinder than the rest of the cylinders.

9. The method of claim 6, wherein the first sensor and the second sensor have same sensitivity to the air-fuel ratio of a second cylinder.

10. The method of claim 9, wherein air-fuel ratio of the second cylinder is imbalanced rich if readings of both the first and the second sensors are rich.

11. The method of claim 9, wherein air-fuel ratio of the second cylinder is imbalanced lean if readings of both the first and the second sensors are lean.

12. The method of claim 6, wherein the air-fuel ratio of the imbalanced cylinder is adjusted based on a magnitude of a fault of the imbalanced cylinder determined based on one of the first sensor and the second sensor with higher sensitivity to the air-fuel ratio of the imbalanced cylinder.

13. The method of claim 6, wherein the first sensor is an UEGO sensor and the second sensor is a HEGO sensor.

14. A method for a multi-cylinder engine, comprising:

detecting a cylinder-to-cylinder imbalance based on each of a first sensor upstream of a catalyst and a second sensor downstream of the catalyst, wherein the first sensor and the second sensor have different sensitivities to an air-fuel ratio of each cylinder;

determining a magnitude of a fault in an imbalanced cylinder based on each of the first and the second sensor; and mitigating the cylinder-to-cylinder imbalance based on the magnitude of the fault by adjusting fuel injected into the imbalanced cylinder.

15. The method of claim 14, wherein the first and second sensors are positioned on opposite sides relative to a central axis of an exhaust passage.

16. The method of claim 14, wherein the first sensor is more sensitive to the air-fuel ratio of a first cylinder than the rest of the cylinders, the second sensor is more sensitive to the air-fuel ratio of a third cylinder than the rest of the cylinders, and the first and the second sensors have a same sensitivity to the air-fuel ratio of a second cylinder.

17. The method of claim 16, wherein the magnitude of the fault of the first cylinder is based on a ratio between relative fuel-air ratios from the first and the second sensors, the magnitude of the fault of the third cylinder is based on a ratio between relative fuel-air ratios from the second and the first sensors.

18. The method of claim 16, wherein the magnitude of the fault of the second cylinder is based on comparing a relative fuel-air ratio from the first sensor with 1.

19. The method of claim 16, wherein the magnitude of the fault of the second cylinder is based on comparing a relative fuel-air ratio from the second sensor with 1.

20. The method of claim 14, wherein the fuel injected in to the imbalanced cylinder is adjusted via updating a multiplier of a fuel injector associated with the imbalanced cylinder, and the amount of update is based on the magnitude of the fault of the imbalanced cylinder.

* * * * *